US009611125B2

(12) United States Patent
Hiebenthal

(10) Patent No.: US 9,611,125 B2
(45) **Date of Patent: *Apr. 4, 2017**

(54) SPRING-DRIVEN REEL

(71) Applicant: Conductix, Inc., Omaha, NE (US)

(72) Inventor: Benjamin B. Hiebenthal, Fremont, NE (US)

(73) Assignee: Conductix, Inc., Omaha, NE (US)

( * ) Notice: Subject to any disclaimer, the term of this patent is extended or adjusted under 35 U.S.C. 154(b) by 172 days.

This patent is subject to a terminal disclaimer.

(21) Appl. No.: 14/492,715

(22) Filed: Sep. 22, 2014

(65) Prior Publication Data

US 2015/0008273 A1 Jan. 8, 2015

Related U.S. Application Data

(63) Continuation of application No. 13/613,585, filed on Sep. 13, 2012, now Pat. No. 8,888,033.

(51) Int. Cl.

| | |
|---|---|
| ***B65H 75/48*** | (2006.01) |
| ***B66C 13/12*** | (2006.01) |
| ***B66D 1/02*** | (2006.01) |

(52) U.S. Cl.

CPC ..... *B65H 75/486* (2013.01); *B66C 13/12* (2013.01); *B66D 1/02* (2013.01)

(58) Field of Classification Search

CPC ..... B65H 75/486; B65H 75/4452; B65H 2403/481

See application file for complete search history.

(56) References Cited

U.S. PATENT DOCUMENTS

| | | | | |
|---|---|---|---|---|
| 2,303,002 | A | 11/1942 | Ruddock | |
| 2,587,652 | A | 3/1952 | Rostine | |
| 2,645,432 | A | 7/1953 | Griffitts | |
| 2,658,698 | A | 11/1953 | Leroy | |
| 3,916,974 | A | 11/1975 | Lidin | |
| 4,611,688 | A | 9/1986 | Sekhar | |
| 5,236,144 | A | 8/1993 | Kautz | |
| 5,833,016 | A | 11/1998 | Carpenter | |
| 5,996,923 | A * | 12/1999 | Junquera | E06B 9/44 160/315 |
| 2007/0272787 | A1 | 11/2007 | Jian | |

FOREIGN PATENT DOCUMENTS

| | | |
|---|---|---|
| JP | 08-231130 | 9/1996 |
| JP | 10-109834 | 4/1998 |

OTHER PUBLICATIONS

International Search Report mailed Oct. 21, 2013, in Application Serial No. PCT/US2013/053185.

* cited by examiner

*Primary Examiner* — Sang Kim

(74) *Attorney, Agent, or Firm* — Ryan T. Grace; Advent, LLP

(57) ABSTRACT

A spring-driven reel is adapted to include a gear assembly, and a reel assembly operatively coupled to at least one gear of the gear assembly. The spring-driven reel can also include at least one spring assembly. The spring assembly can include a screw member and a non-rotatable nut moveably mounted to the screw member.

20 Claims, 8 Drawing Sheets

SPRING-DRIVEN REEL

BACKGROUND

Many types of spring-driven reels have been previously provided for use with cranes, hoists, etc., which employ lines or cables which supply electrical power to a traveling object. As the object is moved away from the reel, the line or cable is unwound from the spool of the reel. As the object is moved towards the reel, the spring rotates the spool to wind the line or cable onto the spool. In the past, most springs were of the "clock" type. Although the "clock" type springs do function well, the life thereof is rather limited which requires extensive disassembly of the reel to replace the spring.

In an effort to overcome the shortcomings of the "clock" type springs, elongated helical or linear springs have been substituted for the "clock" type springs. U.S. Pat. No. 2,303,002 to Ruddock discloses an elongated helical spring which has one end thereof fixed to a support with the other end being rotated to twist the spring into tension as the line is pulled from the spool by the object moving away from the reel. When the object is moved towards the reel, thereby causing slack in the line, the twisted spring unwinds to rotate the spool to wind the line onto the spool. In U.S. Pat. No. 2,645,432, an improvement to the reel of U.S. Pat. No. 2,303,002 is disclosed.

In both of the designs of the aforementioned patents, the rotational twisting of the helical springs eventually causes the spring to fail.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A spring-driven reel is disclosed which can include a gear assembly, a reel assembly operatively coupled to at least one gear of the gear assembly. The spring-driven reel can also include at least one spring assembly. The spring assembly can include a screw member and a non-rotatable nut moveably mounted to the screw member.

BRIEF DESCRIPTION OF THE DRAWINGS

Non-limiting and non-exhaustive embodiments of the disclosure are described with reference to the following figures, wherein like reference numerals refer to like parts throughout the various views unless otherwise specified.

DESCRIPTION

Figure 1:
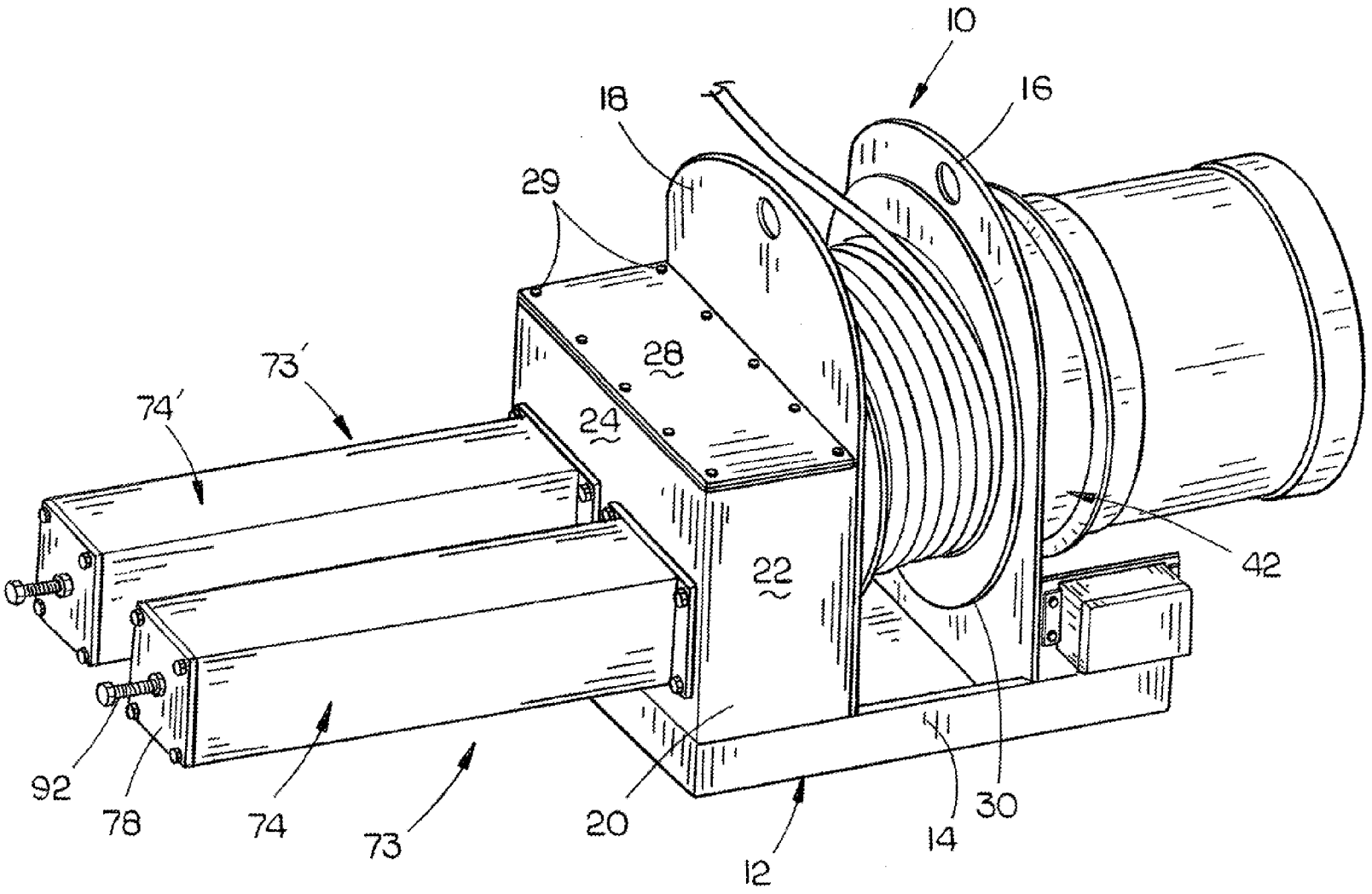
FIG. 1 is a perspective view of the spring-driven reel of this invention with the reel having two helical spring assemblies associated therewith.
Figure 2:
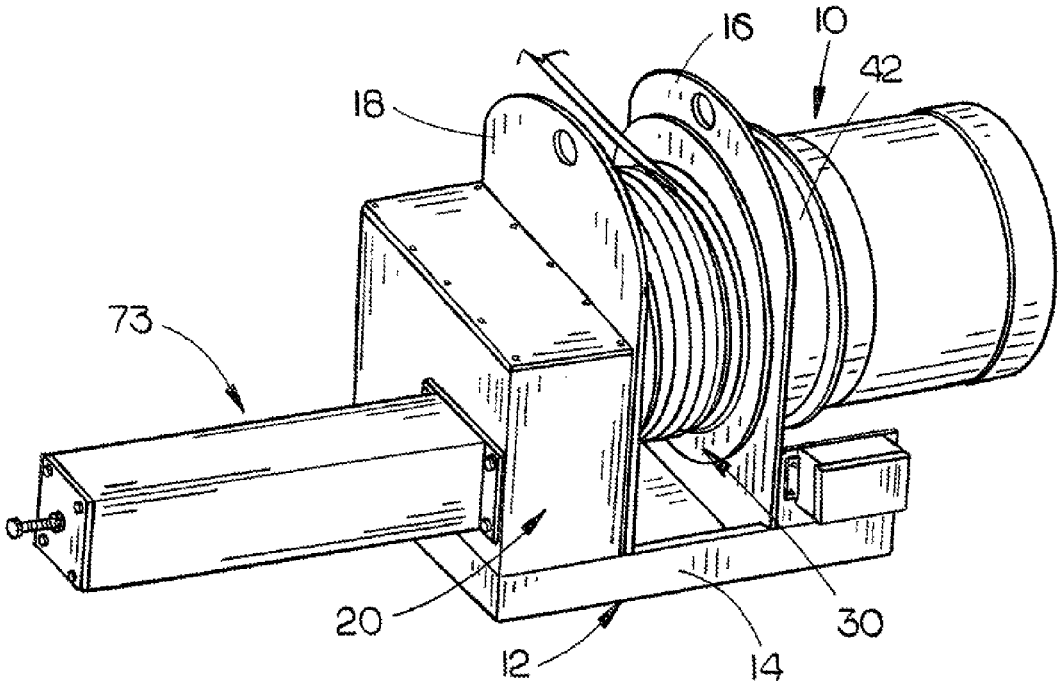
FIG. 2 is a perspective view of the spring-driven reel with the reel having a single helical spring assembly associated therewith.
Figure 3:
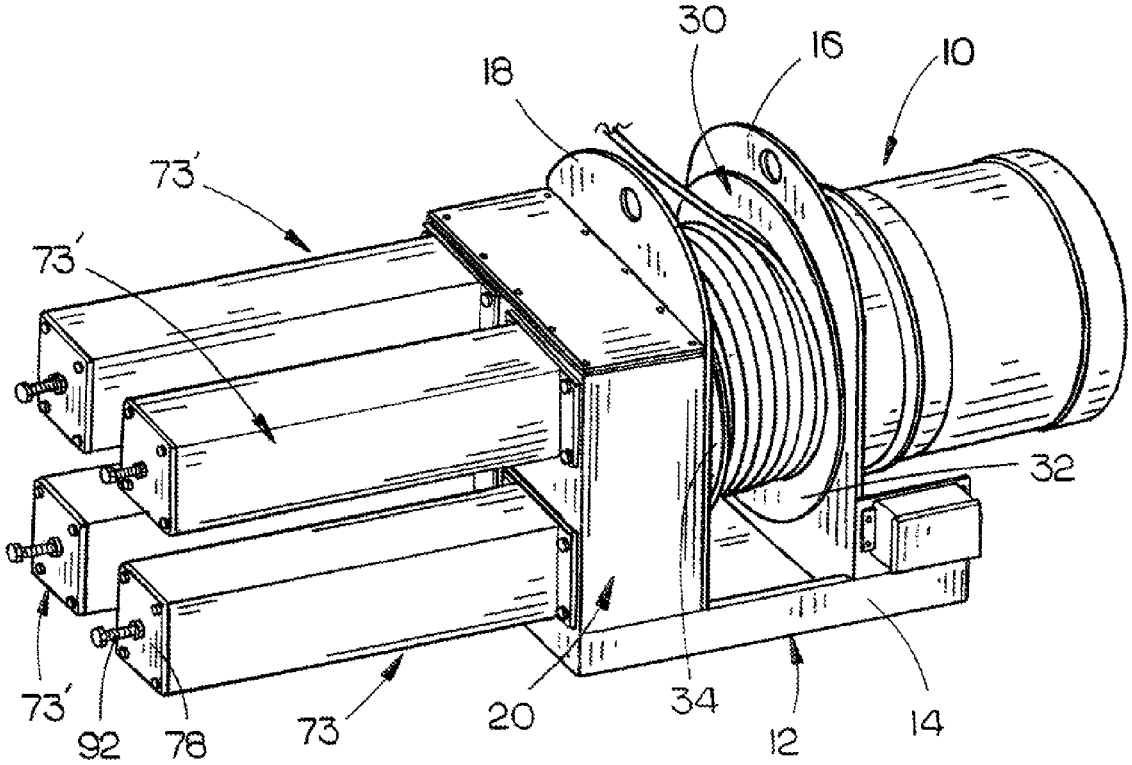
FIG. 3 is a perspective view of the spring-driven reel with the reel having four helical spring assemblies associated therewith.
Figure 4:
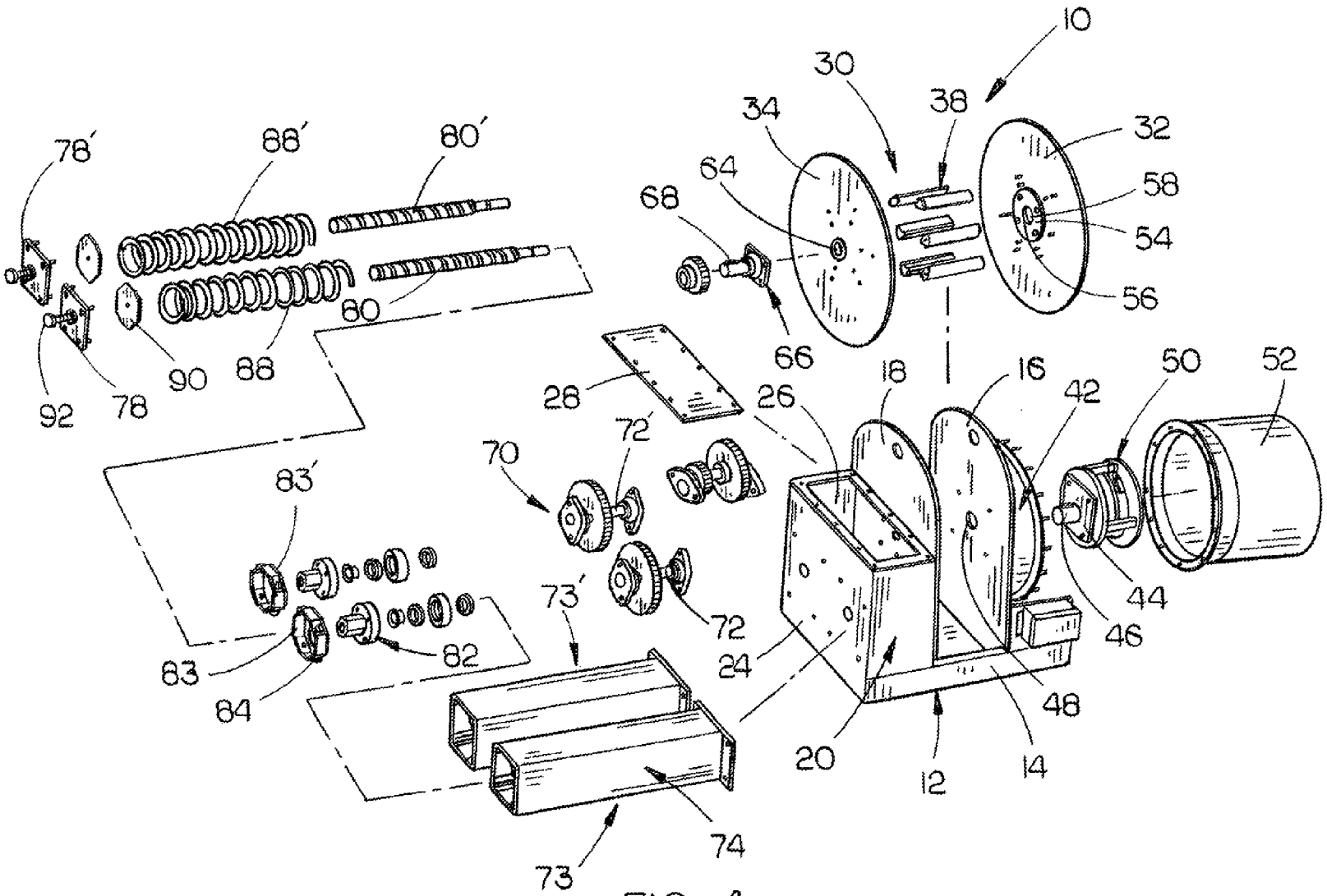
FIG. 4 is an exploded perspective view of the spring-driven reel of FIG. 1.
Figure 5:
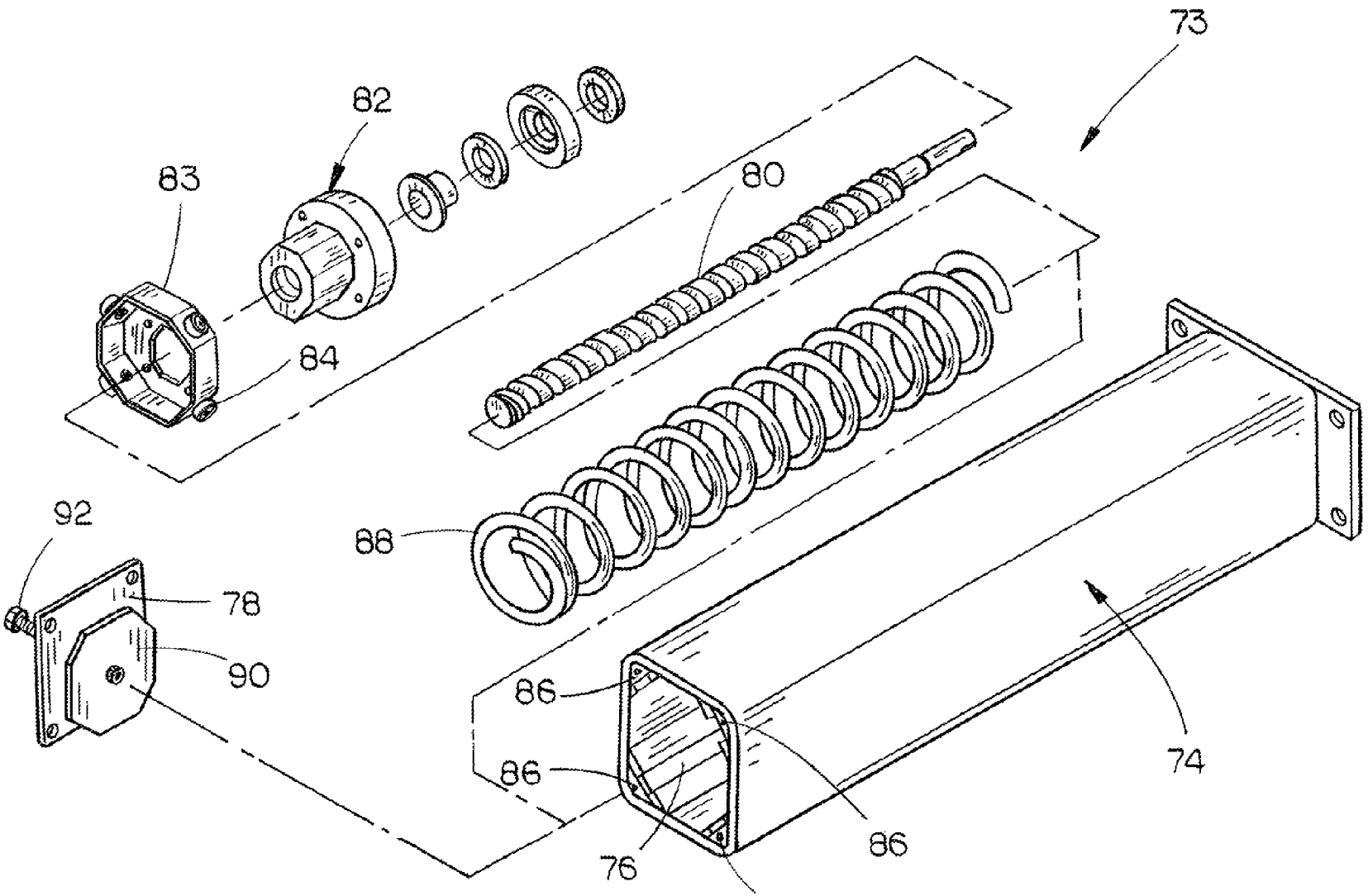
FIG. 5 is an exploded perspective view of the helical spring assembly.
Figure 6:
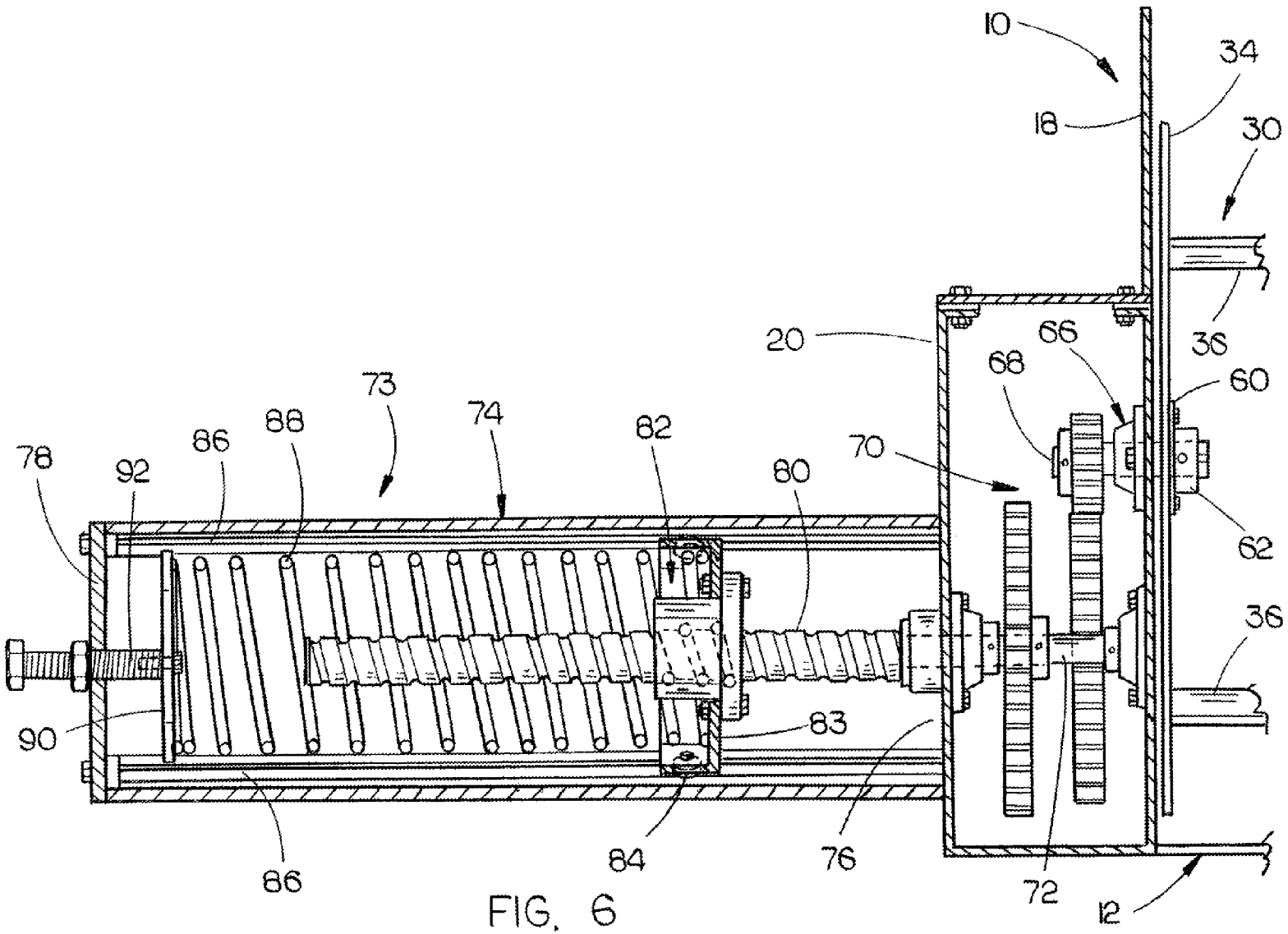
FIG. 6 is a sectional view of the helical spring assembly of FIG. 5.
Figure 7:
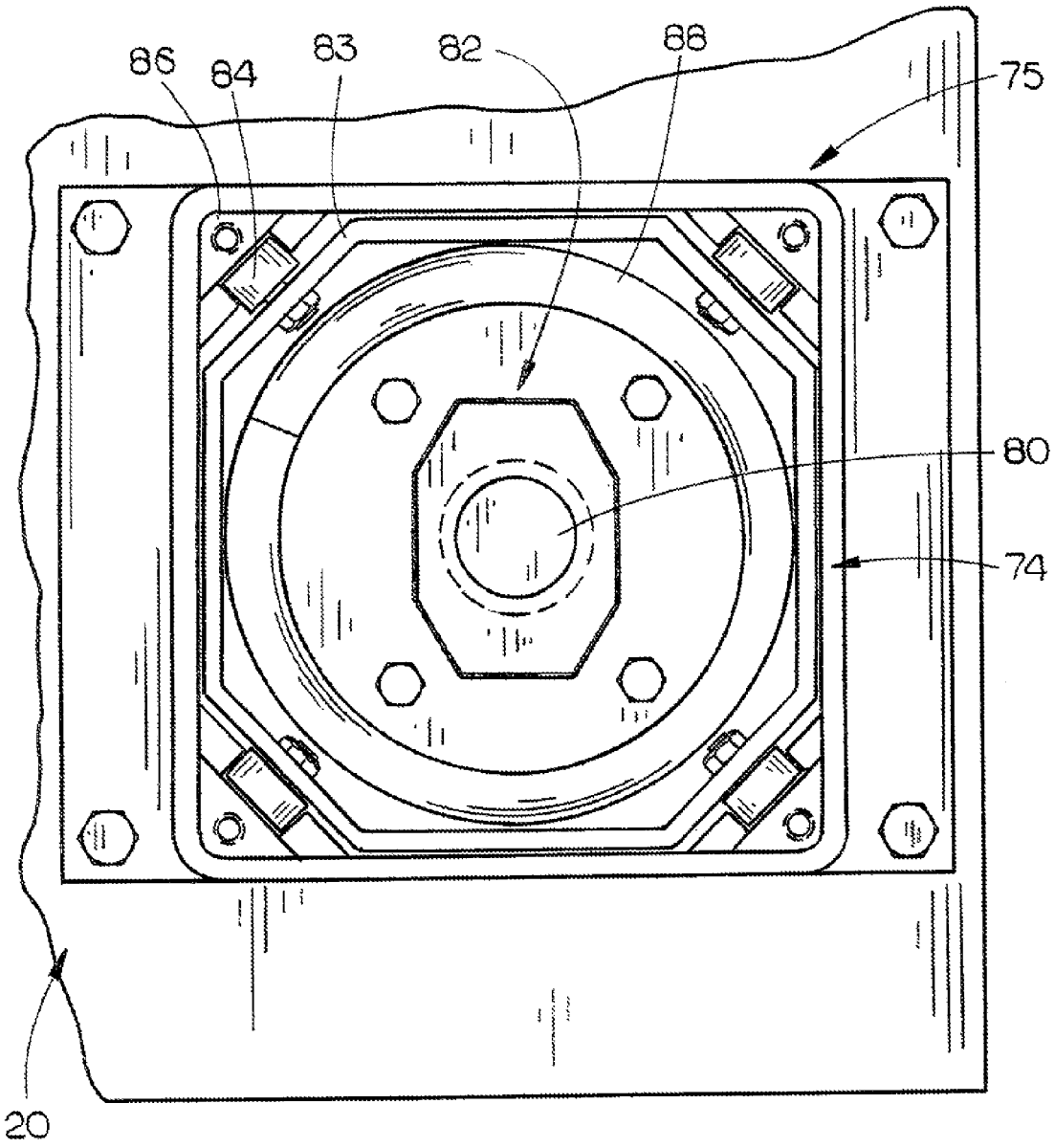
FIG. 7 is an end view of the helical spring assembly of FIG. 5 with the end cap thereof removed.
Figure 8:
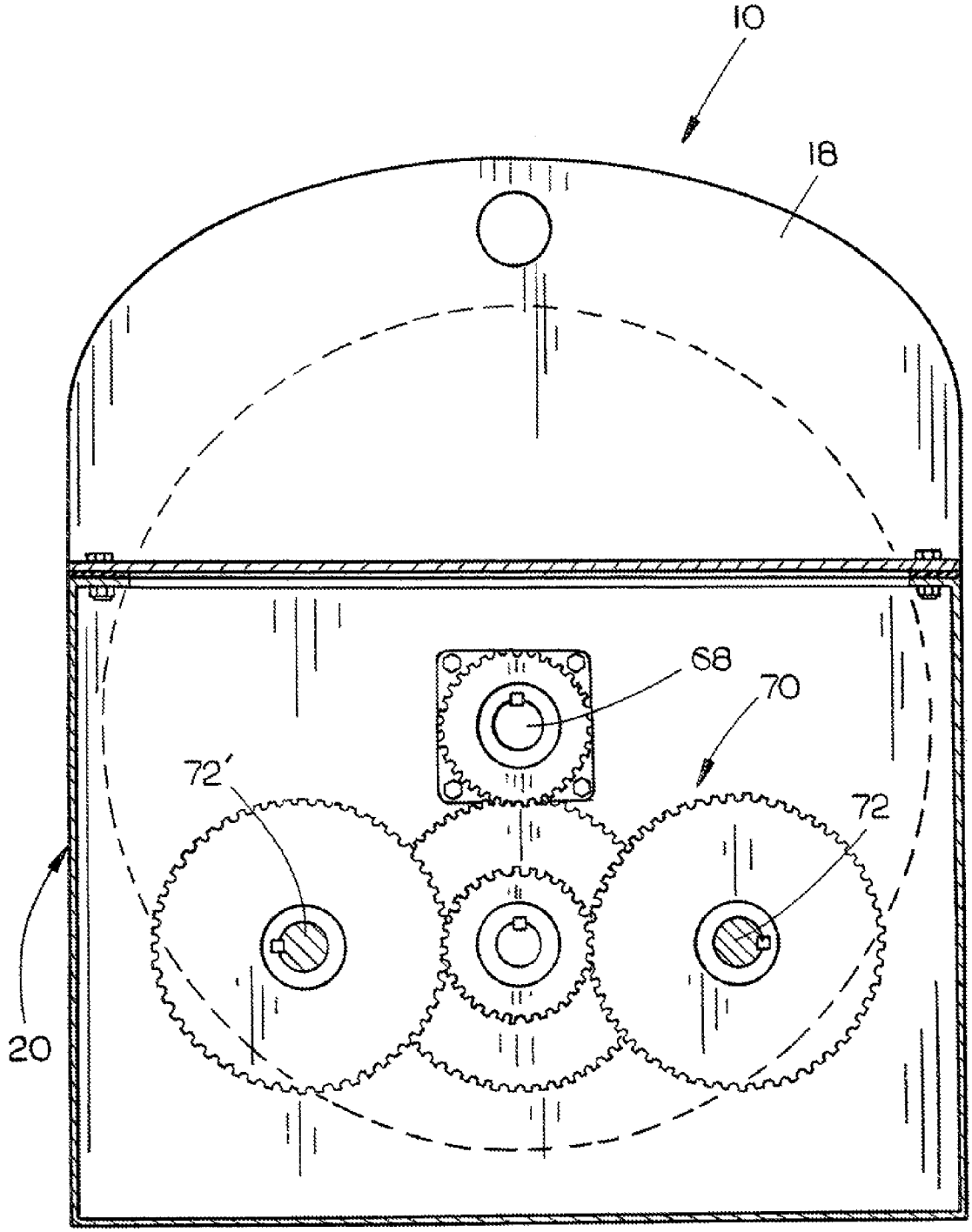
FIG. 8 is a sectional view of the gear assembly when two helical spring assemblies are utilized.
Figure 9:
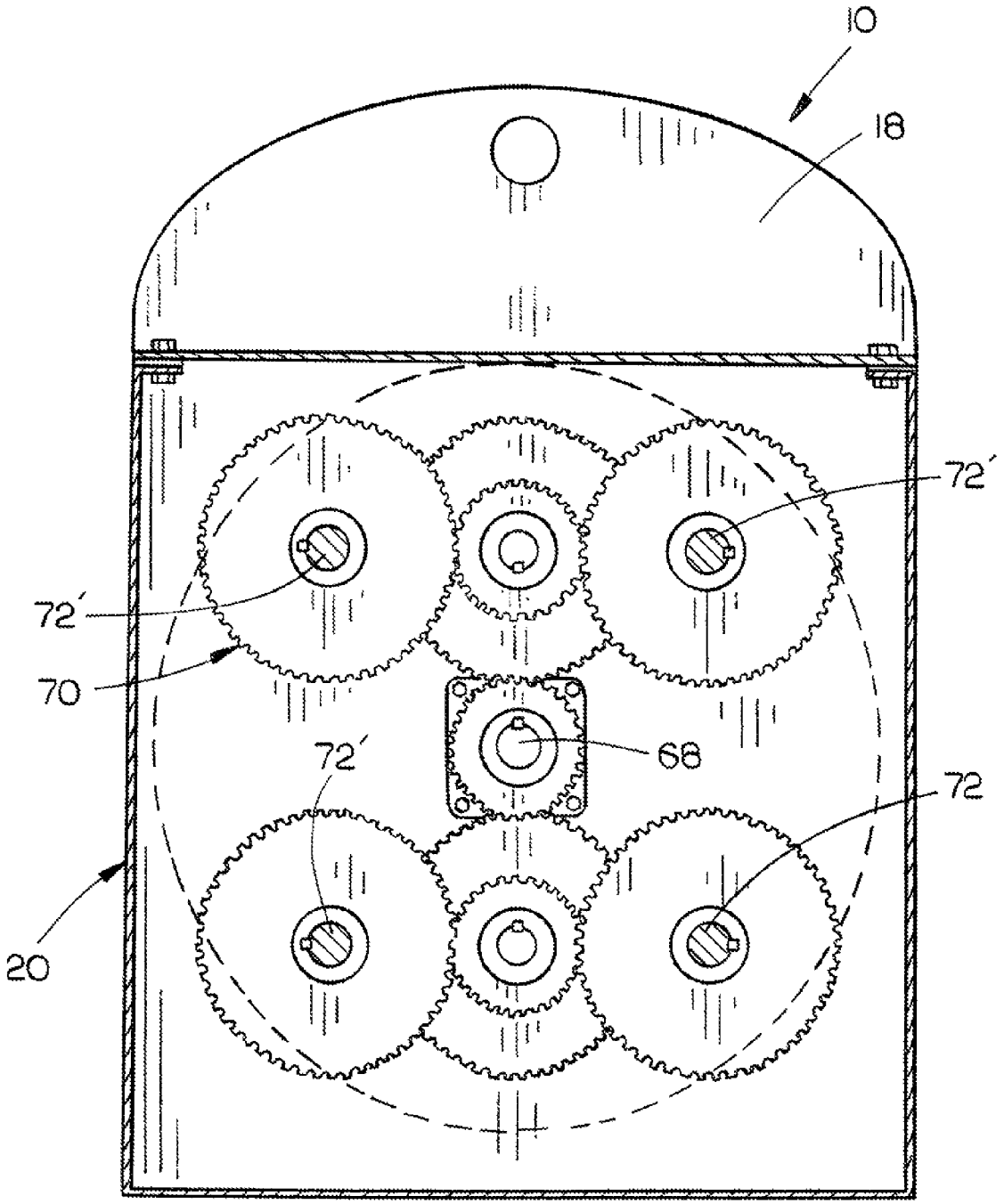
FIG. 9 is a sectional view of the gear assembly when four helical spring assemblies are utilized.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The spring-driven reel is referred to by the reference numeral 10. The reel 10 includes one or more helical spring assemblies as will be described in detail hereinafter. Reel 10 includes a support 12 which is mounted on any convenient supporting structure in a conventional manner such as by bolts, etc. Support 12 includes a horizontally disposed base portion 14. Support members 16 and 18 have their lower ends welded to base portion so that support members 16 and 18 are vertically disposed and are horizontally spaced-apart.

A housing 20 is secured to base portion 14 and support member 18 by welding. The housing 20 includes a first end wall 22, side wall 24, and a second end wall 26. The open upper end of housing 20 is selectively closed by a cover or lid 28 by bolts or screws 29.

The numeral 30 refers to a spool which is positioned between support members 16 and 18 and which is rotatable with respect thereto about a horizontal axis as will be described in greater detail hereinafter. Spool 30 includes spaced-apart flanges 32 and 34. A plurality of spokes 36 have their ends bolted to flanges 32 and 34 so as to extend therebetween to define a drum or drum-like portion 38. A cylindrical slip ring support 42 of convention design is secured to the outer side of support member 16 by bolts or the like. A flange bearing 44 is secured to the outer side of support member 16 by bolts. A slip ring shaft 46 is rotatably mounted in flange bearing 44 which extends through an opening 48 formed in support member 16. Shaft 46 has a conventional slip ring assembly 50 mounted on the outer end thereof. A cover 52 is secured to slip ring support 42 in conventional fashion.

The numeral 54 refers to a disc-shaped plate which has a hub 56 welded thereto. Plate 54 is bolted to the inner side of flange 32 with the hub 56 registering with an opening 58 formed in flange 32. The inner end of shaft 46 extends through the opening 58 in flange 32 and into the hub 56. The shaft 46 is fixed to the hub 56 by a conventional keyway and set screws so that shaft 56 rotates with flange 32 and the spool 30.

The numeral 60 refers to a disc-shaped plate having a hub 62 welded thereto. Plate 60 is bolted to the flange 34 at the inner side thereof so that the hub 62 registers with an opening 64 formed in flange 34. A flange bearing 66 is bolted to the outer side of flange 34 at the opening 64. A shaft 68 extends through flange bearing 66, through opening 64 and into the hub 62. Shaft 68 is secured to the hub 62 by a convention keyway and set screws so that shaft 68 rotates with flange 34 and spool 30. A gear assembly 70 is provided within housing 20 and includes various gears, shafts, bearings, etc., to serve as a connection between the shaft 68 and the helical spring or springs as will be described in more detail hereinafter.

Assuming that two spool retraction devices are to be used, the reel will now be described with the understanding that one or more helical spring assemblies may be used in association with the spool depending upon the length of the line or cable, the thickness of the line or cable, and the weight of the line or cable. Although the drawings illustrate a reel with a single helical spring assembly, a reel with two helical spring assemblies and a reel with four helical spring assemblies, only a single spring assembly will be described in detail with "'" indicating identical structure on the second, third and fourth helical spring assemblies and related components. If the spring-driven reel of this invention includes a single helical spring assembly, the gear assembly 70 will have a single drive shaft 72 which will be rotated by the rotation of the shaft 68 and vice versa. If two helical spring assemblies are being used, the gear assembly 70 will have two drive shafts 72 and 72' which will be rotated by the rotation of shaft 68 and vice versa. The numeral 73 refers to the helical spring assembly. Helical spring assembly 73 includes an elongated, horizontally disposed tubular support 74 having an open inner end 76 which is secured to side wall 24 of housing 20 by bolts, which has an opening formed therein which communicates with the open inner end of support 74. The outer end of support 74 is selectively closed by a cover or plate 78 bolted to support 74. An elongated screw member 80, preferably a conventional ball screw, is rotatably mounted in tubular support 74. A non-rotatable nut 82, preferably a flanged ball nut, is threadably mounted on screw member 80 within tubular support 74 adjacent the inner end of screw member 80. The nut 82 has a square-like support 83 secured thereto which has a configuration such that it cannot rotate with respect to the support 74. The support 83 on nut 82 has rollers 84 mounted on each of the four corners thereof with each of those rollers 84 being received by an elongated guide 86 provided in each of the corners of the support 74. The inner end of the screw member 80 is operatively interconnected to the shaft 68, for rotation therewith, by the gear assembly 70.

An elongated helical spring 88 embraces screw member 80 within support 74 with the inner end thereof being in engagement with the outer side of the nut 82. To enable some tension of the spring to be preset, a plate 90 is positioned in support 74 at the outer end of spring 88. A threaded bolt 92 extends through cover 78 with the inner end of the bolt 92 engaging the plate 90. As the bolt 92 is threadably moved inwardly through the cover 78, the plate 90 will engage the outer end of the spring 88 to slightly compress the spring 88 to yieldably prevent the spool 30 from rotating when in its fully retracted position. If additional spring force is required, one or more of the helical spring assemblies 73 may be used as previously stated.

Assuming that only one helical spring assembly is used with the reel 10, the reel functions as follows. Assuming that the line or cable is wound onto the spool 30, the bolt 92 would have been previously used to move the plate 90 into engagement with the outer end of spring 88 to compress spring 88 somewhat so that the pre-set tension in spring 88 will maintain spool 80 in its retracted position.

As the line or cable is pulled from the spool 30, the spool will rotate in a first unwinding direction. The rotation of spool 30 in the first direction causes the shaft 68 to also rotate in the first direction since it is fixed to flange 34 for rotation therewith. Rotation of shaft 68 in the first direction causes screw member 80 to also rotate due to its interconnection therewith by the gear assembly 70. As screw member 80 rotates in the first direction, the threads on the screw member 80 will cause the ball nut 82 to longitudinally move, without rotation, towards the outer end of the tubular support 74 thereby compressing spring 88 to place the spring 88 in tension. When the object to which the outer end of the line or cable moves towards the reel 10, the line or cable becomes slightly slack. As the line or cable becomes slack, the tension in the spring 88 causes ball nut 82 to longitudinally move, without rotation, towards the inner end of the tubular support 74. The longitudinal movement of ball nut 82 towards the inner end of the tubular support 74 causes ball screw 80 to be rotated in a winding second direction opposite to the first direction thereby causing shaft 68 and spool 30 to be rotated to take up the slack in the line or cable and winding the line or cable onto the spool 30.

As stated above, if a single helical spring assembly 73 is not sufficient enough to wind large or heavy lines or cable onto the spool 30, additional helical spring assemblies 73 could be utilized with the gear assembly 70 driving the ball screws in those assemblies. Additional helical spring assemblies may also be needed if the line or cable is extremely long.

The helical springs 88 in the helical spring assemblies 73 are much more durable than the springs of the prior art. The long life of the springs 88 results in much less repair and/or replacement.

Although the specification has been described in language that is specific to certain structures and methodological steps, it is to be understood that the claims are not necessarily limited to the specific structures and/or steps described. Rather, the specific aspects and steps are described as forms of implementing the claims. Since many embodiments can be practiced without departing from the spirit and scope of the disclosure, the invention resides in the claims hereinafter appended.

The invention claimed is:

1. A spring driven reel, comprising:

a gear assembly;

a reel assembly operatively coupled to at least one gear of the gear assembly; and at least one spring assembly, wherein the spring assembly includes:

a helical spring, a screw member having a first end rotatably coupled to a first end of the spring assembly and a second end operatively coupled to the at least one gear of the gear assembly, wherein the gear assembly is disposed between the reel assembly and the at least one spring assembly, wherein the reel and the screw member rotate with respect to one another via the at least one gear, and a non-rotatable nut movably coupled to the screw member, wherein rotation of the screw member by the reel in a first direction causes lateral movement of the non-rotatable nut to compress the helical spring, wherein lateral movement of the non-rotatable nut caused by decompression of the helical spring rotates the reel in a second direction.

2. The spring driven reel of claim 1, wherein the non-rotatable nut is a flanged ball nut.

3. The spring driven reel of claim 1, wherein the spring assembly includes a tubular support.

4. The spring driven reel of claim 3, wherein the first end of the screw member is rotatably coupled to a plate that is coupled to a first end of the tubular support.

5. The spring driven reel of claim 3, wherein the non-rotatable nut includes a support that includes at least one roller.

6. The spring driven reel of claim 5, wherein the tubular support includes at least one elongated guide, wherein the at least one roller of the non-rotatable nut engages the at least one elongated guide to provide lateral movement.

7. The spring driven reel of claim 1, wherein the screw member is oriented along the length of the helical spring within the helix.

8. The spring driven reel of claim 1, comprising at least a second spring assembly, wherein the at least a second spring assembly includes:

a second helical spring, a second screw member having a first end rotatably coupled to a first end of the second spring assembly and a second end operatively coupled to the at least one gear of the gear assembly, wherein the reel and the second screw member rotate with respect to one another via the at least one gear, and a second non-rotatable nut movably coupled to the second screw member, wherein rotation of the second screw member by the reel in a first direction causes lateral movement of the second non-rotatable nut to compress the second helical spring, wherein lateral movement of the second non-rotatable nut caused by decompression of the second helical spring rotates the reel in a second direction.

9. An assembly for a reel, comprising:

a housing;

a gear assembly housed within the housing;

a helical spring;

a screw member having a first end rotatably coupled to a first end of the spring assembly and a second end configured to be coupled to at least one gear, and a non-rotatable nut movably coupled to the screw member, wherein rotation of the screw member in a first direction causes lateral movement of the non-rotatable nut to compress the helical spring, wherein lateral movement of the non-rotatable nut caused by decompression of the helical spring rotates the screw member in a second direction, wherein the gear assembly is disposed between the reel and the at least one spring assembly, and wherein the gear assembly operatively couples the screw member and the reel to rotate the reel and the screw member with respect to one another.

10. The spring assembly of claim 9, wherein the non-rotatable nut is a flanged ball nut.

11. The spring assembly of claim 9, further comprising a tubular support.

12. The spring assembly of claim 11, wherein the first end of the screw member is rotatably coupled to a plate that is coupled to a first end of the tubular support.

13. The spring assembly of claim 11, wherein the non-rotatable nut includes a support that includes at least one roller.

14. The spring driven reel of claim 13, wherein the tubular support includes at least one elongated guide, wherein the at least one roller of the support engages the at least one elongated guide to provide lateral movement.

15. The spring driven reel of claim 9, wherein the screw member is oriented along the length of the helical spring within the helix of the spring.

16. An assembly for a reel, comprising:

a housing;

a gear assembly housed within the housing;

a tubular member disposed adjacent to the housing;

a helical spring housed within the tubular member;

a screw member housed within the tubular member, the screw member including a first end rotatably coupled to a plate that is coupled to a first end of the tubular support, the screw member including a second end configured to be coupled to at least one gear, and a non-rotatable nut housed within the tubular member, the non-rotatable nut being movably coupled to the screw member, wherein rotation of the screw member in a first direction causes lateral movement of the non-rotatable nut to compress the helical spring, wherein lateral movement of the non-rotatable nut caused by decompression of the helical spring rotates the screw member in a second direction, wherein the gear assembly is disposed between the reel and the at least one spring assembly, and wherein the gear assembly operatively couples the screw member and the reel to rotate the reel and the screw member with respect to one another.

17. The spring assembly of claim 16, wherein the non-rotatable nut is a flanged ball nut.

18. The spring assembly of claim 16, wherein the non-rotatable nut includes a support that includes at least one roller.

19. The spring assembly of claim 18, wherein the tubular support includes at least one elongated guide, wherein the at least one roller of the support engages the at least one elongated guide to provide lateral movement.

20. The spring assembly of claim 16, wherein the screw member is oriented along the length of the helical spring within the helix of the spring.

* * * * *